US011788378B2

(12) United States Patent
Towers et al.

(10) Patent No.: US 11,788,378 B2
(45) Date of Patent: Oct. 17, 2023

(54) LOCALLY POWERED ELECTRIC BALL VALVE MECHANISM

(71) Applicant: Halliburton Energy Services, Inc., Houston, TX (US)

(72) Inventors: Darrin Nathaniel Towers, Shady Shores, TX (US); Kenneth Lemoine Schwendemann, Flower Mound, TX (US); Benjamin Thomas Derryberry, Denton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 206 days.

(21) Appl. No.: 17/299,059

(22) PCT Filed: Jan. 24, 2019

(86) PCT No.: PCT/US2019/014945
§ 371 (c)(1),
(2) Date: Jun. 2, 2021

(87) PCT Pub. No.: WO2020/153961
PCT Pub. Date: Jul. 30, 2020

(65) Prior Publication Data

US 2022/0065071 A1 Mar. 3, 2022

(51) Int. Cl.
*E21B 34/06* (2006.01)

(52) U.S. Cl.
CPC ..... *E21B 34/066* (2013.01); *E21B 2200/04* (2020.05)

(58) Field of Classification Search
CPC ..... E21B 34/066; E21B 220/04
USPC ..... 166/66.6
See application file for complete search history.

(56) References Cited

U.S. PATENT DOCUMENTS

| | | | | |
|---|---|---|---|---|
| 3,137,475 | A | 6/1964 | Schoenecker et al. | |
| 3,430,916 | A | 3/1969 | Raymond, Jr. | |
| 4,140,153 | A * | 2/1979 | Deaton | E21B 34/101 166/324 |

(Continued)

FOREIGN PATENT DOCUMENTS

| | | |
|---|---|---|
| GB | 2493180 | 1/2013 |
| WO | 2014011639 | 1/2014 |

OTHER PUBLICATIONS

Pawlus et al., "Hydraulic vs. Electric: A Review of Actuation Systems in Offshore Drilling Equipment", Modeling, Identification and Control, vol. 37, No. 1, 2016, pp. 1-17.

(Continued)

*Primary Examiner* — Taras P Bemko
(74) *Attorney, Agent, or Firm* — Kilpatrick Townsend & Stockton LLP

(57) ABSTRACT

A system includes a ball valve positionable along a fluid flow path of a wellbore. The ball valve is movable between an open position, where fluid is able to flow through the fluid flow path, and a closed position, where the fluid is prevented from flowing through the fluid flow path. The system also includes an electric motor coupled to a drive system within a trunnion of the ball valve. The electric motor drives rotation of the ball valve to move the ball valve between the open position and the closed position. Further, the system includes a power source electrically coupled to the electric motor to provide power to the electric motor.

20 Claims, 6 Drawing Sheets

(56) References Cited

U.S. PATENT DOCUMENTS 4,149,698 A * 4/1979 Deaton ..... E21B 34/101 166/324
4,375,239 A 3/1983 Barrington et al.
4,632,187 A * 12/1986 Deaton ..... E21B 34/10 166/323
4,636,934 A 1/1987 Schwendemann et al.
4,796,708 A 1/1989 Lembcke
6,343,654 B1 2/2002 Brammer
6,776,240 B2 8/2004 Kenison et al.
6,851,481 B2 2/2005 Vinegar et al.
6,957,699 B2 10/2005 Feluch et al.
9,624,753 B2 4/2017 Stinessen et al.
9,644,752 B2 * 5/2017 Nabors ..... F16K 27/062
2004/0244851 A1 * 12/2004 Joseph, III ..... F16K 5/0605 137/625.32
2008/0289878 A1 11/2008 Livingstone
2009/0096308 A1 * 4/2009 Staudenmann ..... H02K 1/2773 29/598
2011/0180267 A1 7/2011 Wildman et al.
2013/0200286 A1 * 8/2013 Eagen ..... F16K 5/0642 251/315.1
2013/0248203 A1 9/2013 Scott et al.
2014/0174755 A1 * 6/2014 Mitchell ..... F16K 5/0647 137/15.01
2015/0059531 A1 * 3/2015 Ely ..... B25B 21/004 81/57.39
2016/0265521 A1 * 9/2016 Butler ..... F04C 2/1071
2017/0134101 A1 5/2017 Ringgenberg
2018/0094747 A1 4/2018 Dordoni et al.
2019/0085658 A1 * 3/2019 Reid ..... E21B 23/00
2019/0292879 A1 * 9/2019 Gonzales Panta ..... E21B 43/12
2019/0331247 A1 * 10/2019 Hanson ..... F16K 31/047
2020/0088278 A1 * 3/2020 Russikoff ..... F16H 57/0006
2020/0232575 A1 * 7/2020 Dearman ..... F16K 31/0682
2020/0270965 A1 * 8/2020 Vick, Jr. ..... E21B 34/066
2021/0123503 A1 * 4/2021 Firor ..... F16H 1/28
2022/0003070 A1 * 1/2022 Wright ..... F16K 5/0652
2022/0010658 A1 * 1/2022 Angstmann ..... B25J 9/04

OTHER PUBLICATIONS

International Application No. PCT/US2019/014945, International Search Report and Written Opinion, dated Oct. 22, 2019, 11 pages.

* cited by examiner

LOCALLY POWERED ELECTRIC BALL VALVE MECHANISM

TECHNICAL FIELD

The present disclosure relates generally to downhole tools including ball valve mechanisms positioned along a well system. More specifically, though not exclusively, the present disclosure relates to a locally powered electric ball valve mechanism of the well system.

BACKGROUND

A well system (e.g., oil or gas wells for extracting fluids from a conventional or subsea formation) may include ball valve mechanisms positioned along a fluid flow path of the well system. For example, the ball valve mechanisms may be placed along a fluid flow path to isolate sections of the fluid flow path from each other. These ball valve mechanisms may be actuated from a surface of the well system using hydraulic actuation. Multiple hydraulic umbilicals may be used to actuate each ball valve mechanism in the well system. These hydraulic umbilicals take up a large amount of space, especially when stacking multiple ball valve mechanisms within the well system. Additionally, the hydraulic umbilicals may be strapped to tubing running into the well system, and strapping multiple hydraulic umbilicals to the tubing can slow the operation of running the tubing and risk damaging the hydraulic umbilicals. Moreover, maintaining hydraulic umbilicals may be prohibitively expensive under certain circumstances at a wellsite (e.g., on a subsea drilling platform).

DETAILED DESCRIPTION

Certain aspects and examples of the disclosure relate to a locally powered electric ball valve mechanism of a downhole tool positioned within a wellbore or along a fluid flow path of a wellbore. A ball valve may be a valve using a spherical closure element (e.g., a ball) that is rotated a predefined amount to open and close the valve. A ball valve mechanism used for well control may be regulated with a ball valve that is electrically powered. For example, the ball valve may be connected to a power source (e.g., primary cells, rechargeable battery packs, a capacitor bank, etc.) located proximate to the ball valve. Power may be provided to the electric ball valve mechanism locally using an electric power source positioned proximate to the ball valve.

The electric ball valve may eliminate the hydraulic operational requirements by replacing the multiple hydraulic umbilical hoses used for each ball valve with an electric power source and wireless telemetry signaling. The all-electric actuation method may eliminate the use of hydraulic umbilicals and complex control systems at the surface of the wellbore. Additionally, the all-electric actuation may deliver the fast actuation and shearing capabilities used in a subsea or downhole well-control barrier valve.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
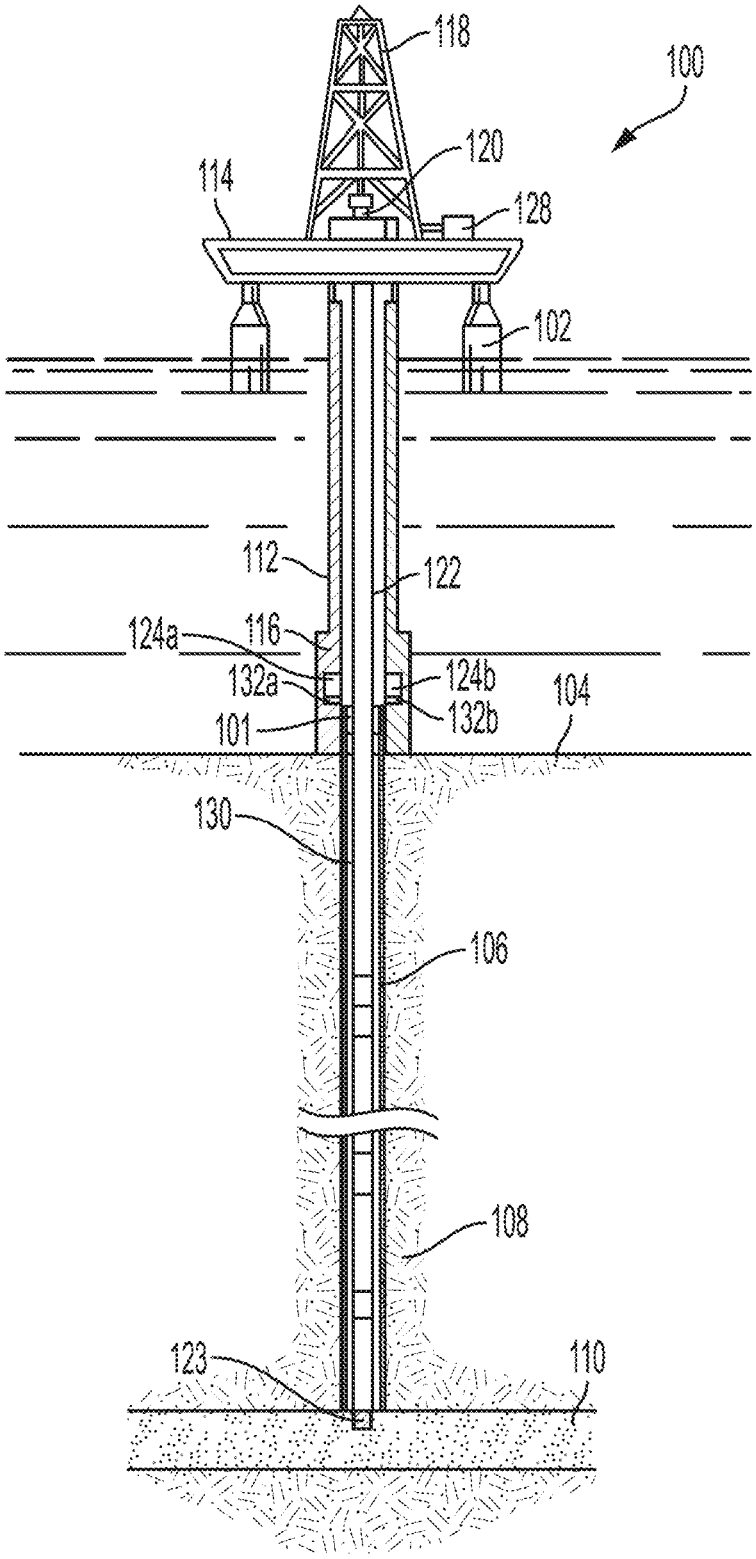
FIG. 1 is a cross-sectional view of an example of a wellbore drilling environment incorporating an electric ball valve mechanism according to some aspects of the present disclosure.

FIG. 1 depicts a cross-sectional view of an example of a wellbore drilling environment 100 incorporating an electric ball valve mechanism 101. A floating workstation 102 (e.g., an oil platform or an offshore platform) can be centered over a submerged oil or gas well located in a sea floor 104 having a wellbore 106. The wellbore 106 may extend from the sea floor 104 through a subterranean formation 108. The subterranean formation 108 can include a fluid-bearing formation 110. A subsea conduit 112 can extend from the deck 114 of the floating workstation 102 into a wellhead installation 116. The floating workstation 102 can have a derrick 118 and a hoisting apparatus 120 for raising and lowering tools to drill, test, and complete the oil or gas well. The floating workstation 102 can be an oil platform as depicted in FIG. 1 or an aquatic vessel capable of performing the same or similar drilling and testing operations. In some examples, the processes described herein can be applied to a land-based environment for wellbore exploration, planning, and drilling.

A drill string 122 can be lowered into the wellbore 106 of the oil or gas well during a drilling operation of the oil or gas well. The drill string 122 can include a drill bit 123 to drill the wellbore 106 in addition to other tools positioned along the drill string that are usable for testing and drilling operations. These tools may include measuring-while-drilling ("MWD") and logging-while drilling ("LWD") tools and devices. Additionally, upon completion of the wellbore 106, other tools may also be lowered into the wellbore 106. For example, a wireline and wireline logging and formation testers may be lowered into the wellbore 106, wellbore stimulation equipment may be lowered into the wellbore 106, production tubing and equipment may be lowered into the wellbore 106, and any other tools usable during drilling, completion, and production within the wellbore 106 may also be lowered into the wellbore 106.

Electric power sources 124*a* and 124*b* located proximate to the electric ball valve mechanism 101 can provide electric power to operate the electric ball valve mechanism 101. The electric power sources 124*a* and 124*b* may include primary cells, rechargeable battery packs, capacitor banks, or any other power storage devices capable of providing power to operate the electric ball valve mechanism 101. In an example, a controller 128 may control operation of the electric ball valve mechanism 101. For example, a telemetry communication system may enable wireless transmission of control signals from the controller 128 to the electric ball valve mechanism 101. The telemetry communication system may include an electromagnetic telemetry system, an acoustic telemetry system, or any other wireless telemetry systems. In another example, a control line (not shown) may be run from the controller 128 to the electric ball valve mechanism 101 to provide the control signals from the controller 128 to the electric ball valve mechanism 101.

The electric ball valve mechanism 101 is controllable to a fully open position (e.g., as illustrated in FIG. 1), to a fully closed position, or to any number of positions between fully open and fully closed. In the fully open position or in a partially open position, the electric ball valve mechanism 101 provides a path for the drill string 122 or other downhole tools and conveyance mechanisms to travel downhole. In the fully closed position, the electric ball valve mechanism 101 closes the path for the drill string 122 or other downhole tools and conveyance mechanisms to travel downhole. Additionally, the fully closed position of the electric ball valve mechanism 101 isolates a portion 130 of the wellbore 106 that is downhole from the electric ball valve mechanism 101 from the subsea conduit 112 located uphole from the electric ball valve mechanism 101. That is, in the fully closed position, the electric ball valve mechanism 101 provides a seal along a fluid path of the wellbore 106.

In one or more examples, the electric ball valve mechanism 101 is able to cut coil tubing (not shown), wireline (not shown), slickline (not shown), or any other downhole conveyance elements when the electric ball valve mechanism 101 transitions to the fully closed position while the downhole conveyance mechanisms are located within the path of the electric ball valve mechanism 101. In this manner, the electric ball valve mechanism 101 is able to isolate the portion 130 from the subsea conduit 112 even when tools are operating within the portion 130 located downhole from the electric ball valve mechanism 101. Further, auxiliary power sources 132*a* and 132*b* (e.g., an additional primary cell, rechargeable battery pack, capacitor bank, a nitrogen charge, or a propellant) may be located at or near the electric ball valve mechanism 101. The auxiliary power sources 132*a* and 132*b* may provide sufficient auxiliary power to the electric ball valve mechanism 101 to automatically close the electric ball valve mechanism 101 in the event that the electric power sources 124*a* and 124*b* dissipate below an operational power threshold.

As illustrated, the electric ball valve mechanism 101 may be positioned within the wellhead installation 116. For example, the electric ball valve mechanism 101 may be coupled to a blowout preventer (BOP) component (not shown) of the wellhead installation 116. In additional examples, one or more of the electric ball valve mechanisms 101 may be positioned anywhere along the subsea conduit 112 and the wellbore 106. The isolation and auto-close capabilities of the electric ball valve mechanism 101 in a compact form factor may enable the electric ball valve mechanism 101 to operate as a primary well-control barrier. Additionally, the electric power actuation of the electric ball valve mechanism 101 provides fast actuation and shearing capabilities (e.g., for wireline, slickline, and coil tubing) usable at the wellhead installation 116 in a subsea environment or as a downhole barrier valve in a land-based or subsea environment.

Figure 2:
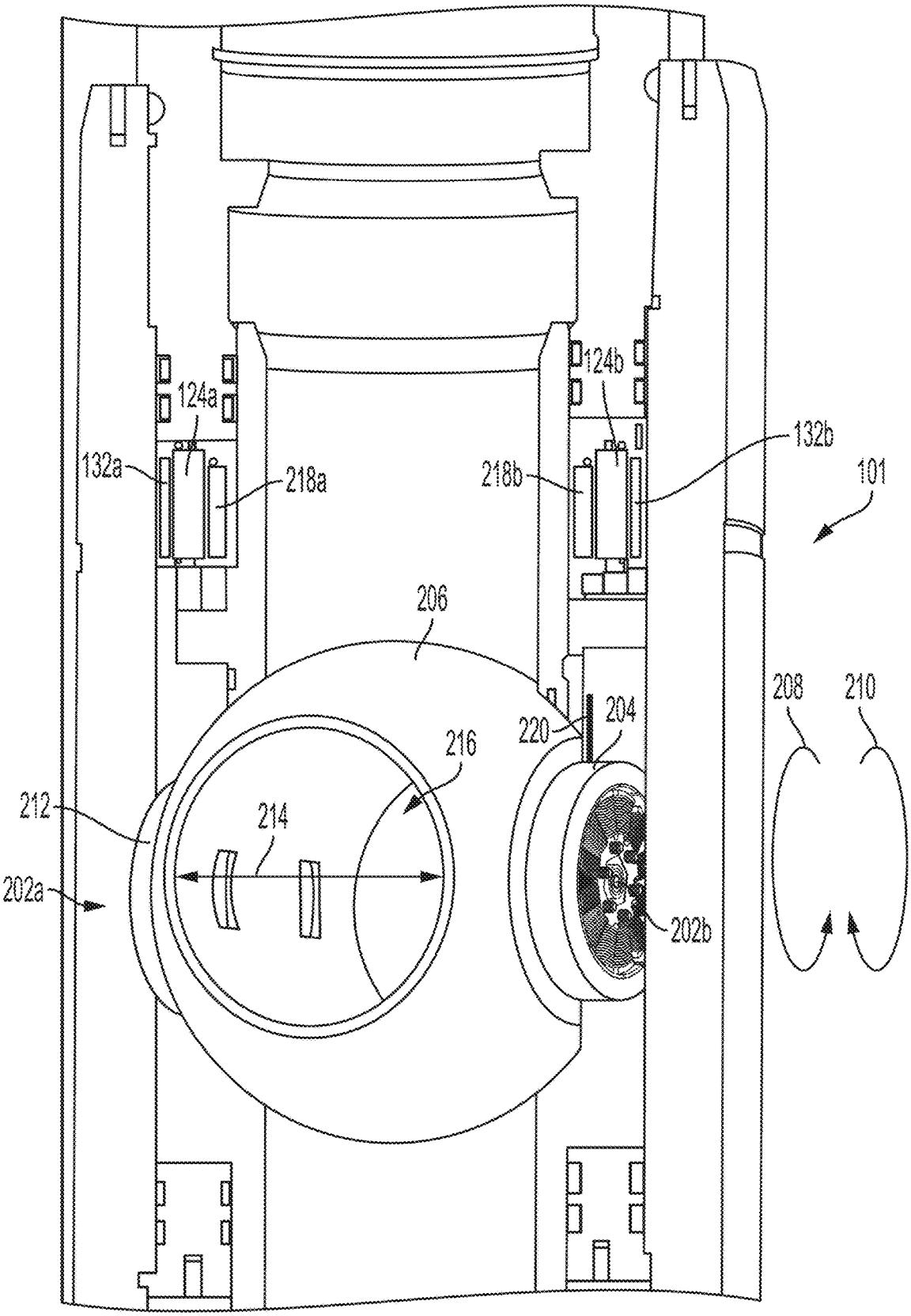
FIG. 2 is a cross-sectional view of the electric ball valve mechanism of FIG. 1 with an electric motor according to some aspects of the present disclosure.

FIG. 2 is a cross-sectional view of the electric ball valve mechanism 101 with an electric motor 202*b*. The electric motor 202*b*, which is positioned adjacent to or within a trunnion 204 of a ball valve 206, may be a brushless motor, a harmonic drive motor, or a cycloid gear system motor. In one or more examples, an application of electric power from the electric power source 124*b* to the electric motor 202*b* may result in rotation of the ball valve 206. For example, the electric motor 202*b* may include a rotor that rotates when the electric motor 202*b* is energized. Additionally, the rotating rotor may provide an actuation force on a drive system (e.g., gears, drive shafts, a disengaging mechanism 602, any other mechanism that translates rotational force from the electric motor 202*a* or 202*b* to the ball valve 206, etc.) of the ball valve 206 that causes the ball valve 206 to rotate. The ball valve 206 may rotate in a direction 208 or a direction 210 depending on a rotation direction of the rotor. Further, the ball valve 206 may rotate a full 360 degrees in either the direction 208 or the direction 210. The auxiliary power sources 132*a* and 132*b* may provide sufficient auxiliary power to the electric ball valve mechanism 101 to automatically close the electric ball valve mechanism 101 in the event that the electric power sources 124*a* and 124*b* dissipate below an operational power threshold.

An additional electric motor 202*a* may be positioned adjacent to or within a trunnion 212 of the ball valve 206. The electric motor 202*a* may also be a brushless motor, a harmonic drive motor, or a cycloid gear system motor. In one or more examples, an application of electric power from the electric power source 124*a* to the electric motor 202*a* may result in rotation of the ball valve 206. For example, the electric motor 202*a* may include a rotor that rotates when the electric motor 202*a* is energized. Additionally, the rotating rotor may provide an actuation force to the ball valve 206 that causes the ball valve 206 to rotate. The actuation force from electric motor 202*a* may act on the ball valve 206 such that the ball valve 206 rotates in the direction 208 or the direction 210 depending on a rotation direction of the rotor. Further, the ball valve 206 may rotate a full 360 degrees in either the direction 208 or the direction 210. In operation, the electric motor 202*a* and the electric motor 202*b* may each provide an actuation force on the ball valve 206 in the same direction 208 and 210 to multiply the actuation force acting on the ball valve 206.

As illustrated, the ball valve 206 is in a fully closed position. That is, the ball valve 206 is in a position that creates a seal between portions of the wellbore 106 downhole from the ball valve 206 and any portions of the wellbore 106 or subsea conduit 112 uphole from the ball valve 206. By rotating the ball valve 206 in the direction 208 or the direction 210, the ball valve 206 may be partially opened or fully opened to enable a flow of fluid through the ball valve 206 or to enable a deployment of downhole tools within the wellbore 106. Further, because the ball valve 206 is actuated with the electric motors 202*a* and 202*b* located in or adjacent to the trunnions 204 and 212 of the ball valve 206, any downhole tools with a diameter that is smaller than a diameter 214 of a through-bore 216 are capable of deployment downhole within the wellbore 106.

To improve torque available to act on the ball valve 206, each of the trunnions 204 and 212 of the ball valve 206 may include a planetary gear system to multiply the torque provided by the electric motors 202*a* and 202*b* to the ball valve 206. Moreover, the electric motors 202*a* and 202*b* may include control systems with downhole motor drive circuits 218*a* and 218*b*, respectively. The downhole motor drive circuits 218*a* and 218*b* may receive control signals originating from the controller 128 through the wireless telemetry system or through control lines running between the controller 128 and the electric ball valve mechanism 101.

Upon receipt of the control signals, the downhole motor drive circuits 218*a* and 218*b* may provide actuation signals to the electric motors 202*a* and 202*b* to provide the actuation force that rotates the ball valve 206. Additionally, the motor drive circuits 218*a* and 218*b* may provide a position indication to the controller 128 such that the controller 128 is able to determine a precise position of a rotation of the ball valve 206. In an example, the rotation of the ball valve 206 may be tracked using a Hall effect sensor or any other position indicator located at the electric ball valve mechanism 101.

Further, the electric ball valve mechanism 101 may include a solenoid locking mechanism 220. For example, the solenoid locking mechanism 220 may be a solenoid actuated rod that is actuated by the solenoid into an opening of the trunnion 204 or 212 to lock the ball valve 206 in place. Additionally, a separate solenoid valve may be positioned in the electric ball valve mechanism 101 to equalize uphole and downhole pressure surrounding the ball valve 206 when the ball valve 206 is opened from the closed position. Equalizing the pressure surrounding the ball valve may reduce a rotational force necessary to act on the ball valve 206 to begin rotation of the ball valve 206 from the closed position to an open position.

Figure 3:
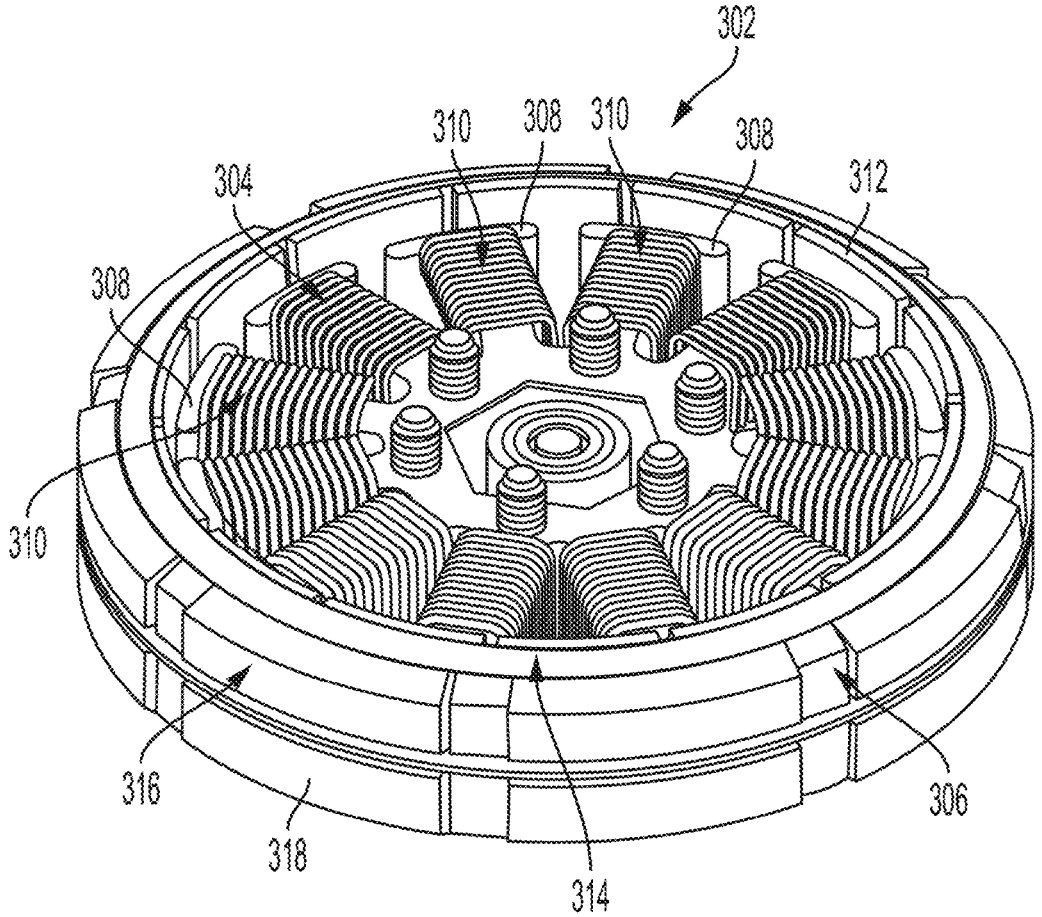
FIG. 3 is a perspective view of a brushless motor usable as the electric motor of FIG. 2 according to some aspects of the present disclosure.

FIG. 3 is a perspective view of a brushless motor 302 usable as the electric motors 202*a* and 202*b*. The brushless motor 302 may include a stator 304 (i.e., a stator assembly) positioned within a rotor 306 (i.e., a rotor assembly). The stator 304 may include a number of poles 308, and each of the poles 308 may be wrapped by a coil 310. As electric power is provided to the coils 310 (e.g., from the electric power source 124*a* or 124*b*), a magnetic field is generated around the coils 310 and the poles 308 to generate an electromagnet. A strength of the magnetic field (e.g., a strength of the electromagnet) may be proportional to the amount of current flowing through the coils 310. In an example, the stator 304 may include 9, 12, or 18 poles 308. In other examples, more or fewer poles 308 may be used in the stator 304.

The rotor 306 of the brushless motor 302 may be positioned around the stator 304. The rotor 306 may include rotor magnets 312 positioned around an inner surface 314 of the rotor 306. The rotor magnets 312 may be permanent magnets such as rare-earth magnets. In an example, the rotor magnets 312 may be neodymium magnets. While FIG. 3 depicts the brushless motor 302 with 14 rotor magnets 312 of the rotor 306 and 12 poles 308 of the stator 304, more or fewer rotor magnets 312 and poles 308 are also contemplated depending on a desired amount of torque available for the brushless motor 302.

Electronic speed controllers (ESCs), which may be a component of the downhole motor drive circuits 218*a* and 218*b*, may control the brushless motor 302 by activating and deactivating sections of electromagnets in the stator 304. The activation and deactivation of the electromagnets in the stator 304 may result in the rotor 306 spinning around the stator 304. For example, the magnetic fields generated by the activated electromagnets of the stators interact with alternating polarities of the rotor magnets 312 of the rotor 306 to cause the rotor 306 to spin around the stator 304.

In an example, the rotor 306 may also include a centrifugal clutch 316. The centrifugal clutch 316 may expand outward when the rotor 306 reaches an activation rotational speed of the centrifugal clutch 316. In an example, when the centrifugal clutch 316 expands outward, friction pads 318 of the centrifugal clutch may interact with one of the trunnions 204 or 212 of the ball valve 218 that surrounds the rotor 306. The interaction of the friction pads 318 with the trunnion 204 or 212 causes the ball valve 206 to rotate in the direction of rotation of the rotor 306 of the brushless motor 302. In another example, when the centrifugal clutch 316 expands outward, friction pads 318 of the centrifugal clutch may interact with a drum (not shown) that surrounds the rotor 306 and is connected to a drive shaft (not shown) of the brushless motor 302. While the centrifugal clutch 316 is expanded, the rotation of the rotor 306 drives the drive shaft, which may drive a planetary gear system (not shown) of the ball valve 206.

Figure 4:
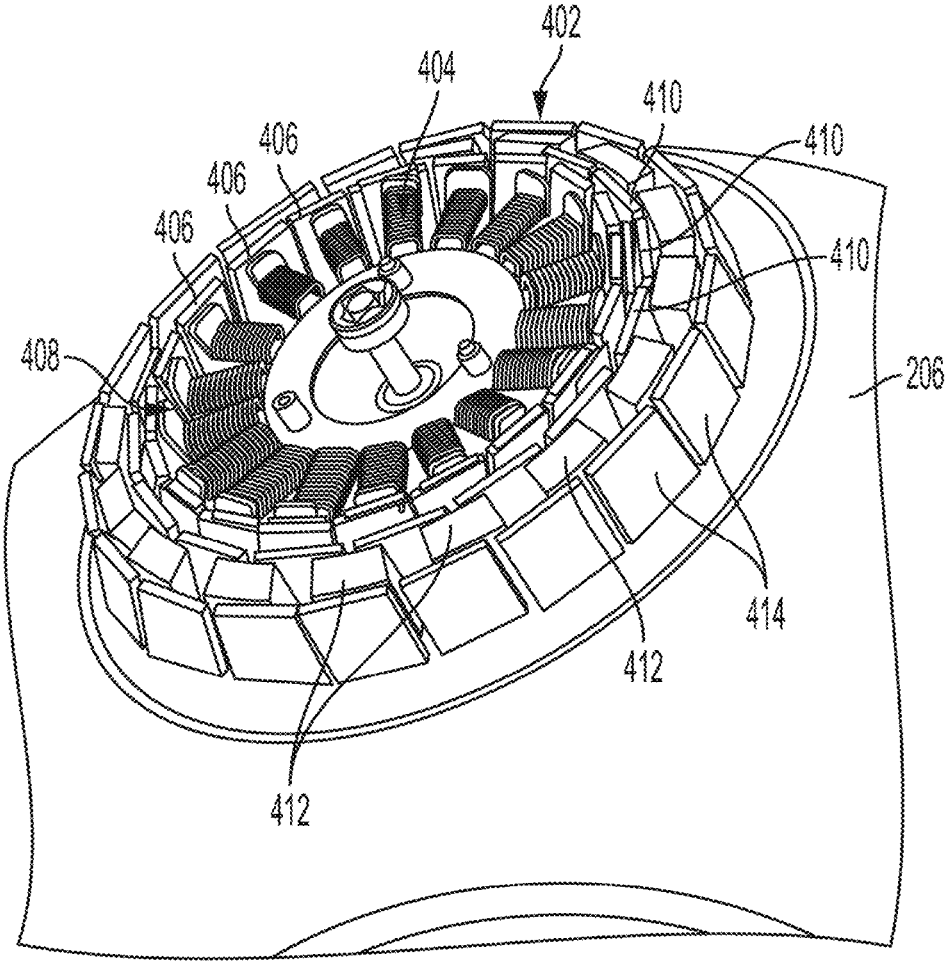
FIG. 4 is a perspective view of a harmonic drive motor usable as the electric motor of FIG. 2 according to some aspects of the present disclosure.

FIG. 4 is a perspective view of a harmonic drive motor 402 (i.e., a harmonic drive system) usable as the electric motor 202*a* or 202*b* to rotate the ball valve 206. The harmonic drive motor 402 may include a stator 404 that operates similarly to the stator 304 described above with respect to FIG. 3. The harmonic drive motor 402 may also include permanent magnets 406 forming a rotor 408 positioned around the stator 404. The permanent magnets 406 may interact with the magnetic fields generated by the stator 404 to rotate the rotor 408 around the stator 404.

Positioned around an outer circumference of the rotor 408 is a set of coaxial gear inner magnets 410. The harmonic drive motor 402 may also include coaxial gear poles 412 in a ring around the coaxial gear inner magnets 410. The coaxial gear poles 412, which may be made from steel, may be attached to the ball valve 206. A ring of coaxial gear outer magnets 414 may also be positioned circumferentially around the coaxial gear poles 412. The coaxial gear outer magnets 414 may couple to a housing of the harmonic drive motor 402. A combination of the coaxial gear inner magnets 410, the coaxial gear poles 412, and the coaxial gear outer magnets 414 may collectively be referred to as coaxial magnetic gears. of the harmonic drive motor 402.

In an example, the coaxial gear poles 412 act as flux paths for the magnetic fields of the coaxial gear inner magnets 410 and the coaxial gear outer magnets 414. By selecting a number of the coaxial gear outer magnets 414 to be equal to a difference between a number of the coaxial gear poles 412 less a number of the coaxial gear inner magnets 410, the coaxial gear poles 412 may couple to a harmonic field to generate a gear ratio. In this manner, a rotational force acts on the coaxial gear poles 412, which are coupled to the ball valve 206, in a manner similar to a planetary gear system. That is, the torque from the rotor 408 is multiplied at the coaxial gear poles 412 while the rotational speed of the coaxial gear poles 412 is reduced in comparison to the rotational speed of the rotor 408.

Figure 5:
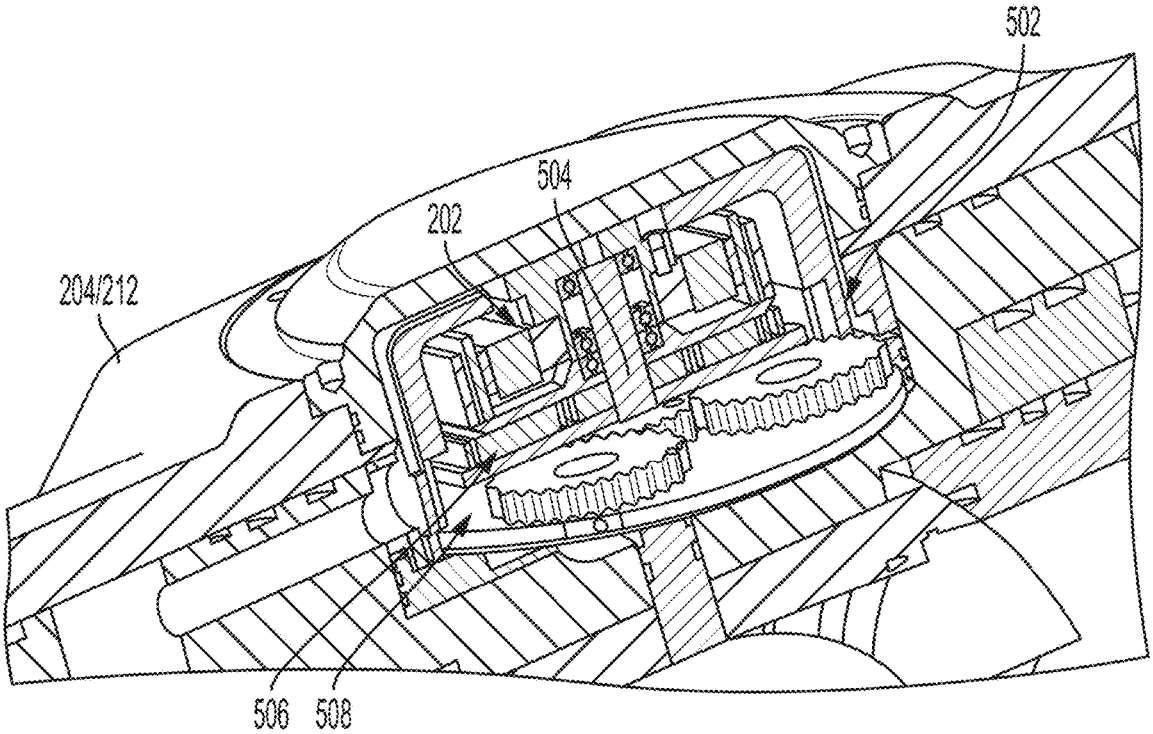
FIG. 5 is a cross-sectional view of a planetary gear system of the electric ball valve mechanism of FIG. 1 according to some aspects of the present disclosure.

FIG. 5 is a cross-sectional view of a planetary gear system 502 of the electric ball valve mechanism 101. As illustrated, the electric motor 202*a* or 202*b* (i.e., the electric motor 202) is positioned within the trunnion 204 or 212. The electric motor 202 may be the brushless motor 302 or the harmonic drive motor 402, as discussed above with respect to FIGS. 3 and 4, respectively. The electric motor 202 may also be a cycloid gear system motor or any other type of electric motor capable of operating at or within the trunnions 204 and 212.

In an example, the electric motor 202 applies a rotational force on a drive shaft 504. The drive shaft 504, in turn, supplies the rotational force to the planetary gear system 502. As illustrated, the planetary gear system 502 may be a dual planetary gear system with a first stage 506 and a second stage 508. The second stage 508 is depicted in a perspective view to illustrate details of the planetary gearing. The dual planetary gear system 502 operates as a torque multiplier on the torque generated by the electric motor 202.

In an example, the planetary gear system 502 provides a 25 to 1 gear ratio. That is, the torque output by the planetary gear system 502 is 25 times greater than a torque input to the planetary gear system 502 by the electric motor 202. In an example where the electric motor 202 generates 3 to 4 foot-pounds of torque, the output torque of the planetary gear system 502 on the ball valve 206 may be between 75 and 100 foot-pounds of torque. Additionally, when the ball valve 206 includes two electric motors 202, the total torque available to act on the ball valve 206 may be between 150 and 200 foot-pounds of torque.

Other gear ratios are also contemplated. For example, the planetary gear system 502 may include a single planetary gear. In such an example, the gear ratio may be a fraction of the gear ratio of the dual planetary gear system described above (e.g., a 5 to 1 gear ratio). In other examples, the gears in the dual planetary gear system may be adjusted to increase or decrease the gear ratio of the dual planetary gear system.

Figure 6:
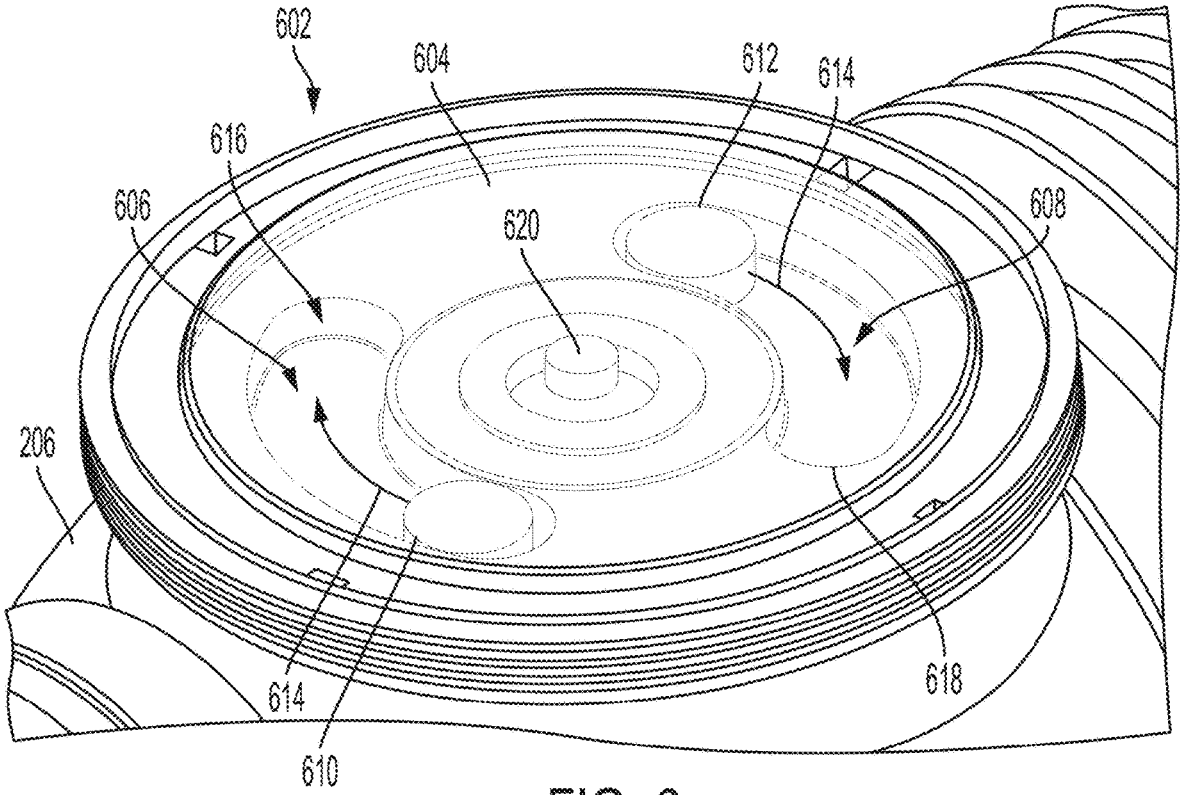
FIG. 6 is a perspective view of a disengaging mechanism that disengages the electric motor of FIG. 2 according to some aspects of the present disclosure.

FIG. 6 is a perspective view of a disengaging mechanism 602 that disengages the electric motor 202 from the ball valve 206. As illustrated, the disengaging mechanism 602 may include a plate 604 with two slots 606 and 608. The electric motor 202 may be mechanically attached to pins 610 and 612 that move within the slots 606 and 608, respectively. When the electric motor 202 provides a rotational force on the pins 610 and 612 in a direction 614, the pins 610 and 612 move within the slots 606 and 608 until the pins 610 and 612 abut ends 616 and 618 of the slots 606 and 608. Upon reaching the ends 616 and 618, the pins 610 and 612 apply the rotational force from the electric motor 202 to the plate 604. Because the plate 604 is mechanically attached to the ball valve 206, the rotational force provided by the pins 610 and 612 on the ends 616 and 618 may result in rotation of the ball valve 206.

By disengaging the electric motor 202 from the ball valve 206, the electric motor 202 is able to rotate for a specified number of degrees before rotational force is provided from the electric motor 202 to the ball valve 206. As illustrated, because the slots 606 and 608 each represent a quarter of a circular path around a center 620 of the plate 604, the electric motor 202 may move 90 degrees before the ball valve 206 begins turning. The slots 606 and 608 may increase or decrease in length to increase or decrease a number of degrees that the electric motor 202 turns before engaging the plate 604 and turning the ball valve 206.

At startup of the electric motor 202, very little torque may initially be produced. As the electric motor 202 spins up, the torque produced by the electric motor 202 may increase quickly. The disengagement of the electric motor 202 from the ball valve 206 may prevent the electric motor 202 from stalling out on startup before the electric motor 202 produces enough torque to move the ball valve 206.

Figure 7:
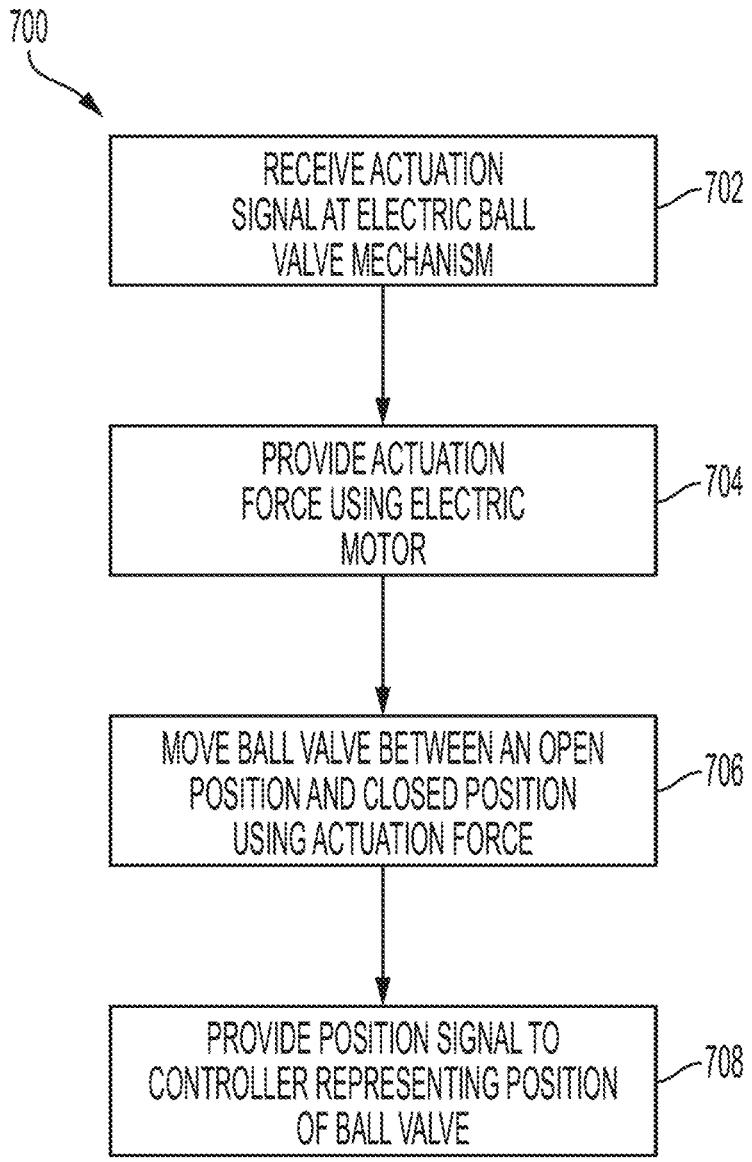
FIG. 7 is a flowchart of a process for operating the electric ball valve mechanism of FIGS. 1-6 according to some aspects of the present disclosure.

FIG. 7 is a flowchart of a process 700 for operating the electric ball valve mechanism 101. At block 702, the process 700 involves receiving an actuation signal at the electric ball valve mechanism 101. In an example, the actuation signal may be a control signal from the controller 128. The actuation signal may be received at the electric ball valve mechanism 101 using an acoustic or electromagnetic telemetry system. In another example, the actuation signal may be received at the electric ball valve mechanism 101 using a control line from the controller 128 to the electric ball valve mechanism 101.

At block 704, the process 700 involves providing an actuation force to the ball valve 206 of the electric ball valve mechanism 101 using the electric motor 202. The electric motor may be the brushless motor 302, the harmonic drive motor 402, or a cycloid gear system motor with a cycloid drive system. In an example, the electric motor 202 may be any other type of electric motor positionable within the wellbore 106 without impeding tools or a flow of fluid within the wellbore 106. In one or more examples, the electric motor 202 may provide the actuation force using the planetary gear system 502 to multiply the torque provided by the electric motor 202. Further, the electric motor 202 may be a single electric motor, or the electric motor may be multiple electric motors.

At block 706, the process 700 involves moving the ball valve 206 of the electric ball valve mechanism 101 between an open position and a closed position using the actuation force of the electric motor 202. In an example, the actuation force of the electric motor 202 may operate on the planetary gear system 502 to move the ball valve 206 between the open position and the closed position. In other examples, the actuation force from the electric motor 202 may act directly on the ball valve 206 to move the electric ball valve mechanism 101 between the open and closed positions. Further, in one or more examples, the actuation force provided by the electric motor 202 is sufficient to cut a slickline, a wireline, or a coil tubing extending through the through-bore 216 of the ball valve 206 as the ball valve 206 moves from the open position to the closed position.

At block 708, the process 700 involves providing a position signal to the controller 128 that represents a position of the ball valve 206. For example, a Hall effect sensor or other position sensor may detect if the ball valve 206 is in a closed position, an open position, or a position between the open position and the closed position. The electric ball valve mechanism 101 may provide an indication of the position detected by the sensor to the controller 128 such that the controller is able to accurately track a current position of the ball valve 206.

In some aspects, systems, devices, and methods for operating an electric ball valve mechanism are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a ball valve positionable along a fluid flow path of a wellbore, the ball valve being movable between an open position, where fluid is able to flow through the fluid flow path, and a closed position, where the fluid is prevented from flowing through the fluid flow path; an electric motor coupleable to a drive system within a trunnion of the ball valve and positionable to drive rotation of the ball valve to move the ball valve between the open position and the closed position; and a power source electrically coupleable to the electric motor to provide power to the electric motor.

Example 2 is the system of example 1, further comprising: an additional electric motor coupleable to an additional drive system within an additional trunnion of the ball valve and positionable to drive rotation of the ball valve, wherein the electric motor and the additional electric motor are each positionable to drive rotation of the ball valve in a same rotational direction.

Example 3 is the system of examples 1-2, wherein the electric motor comprises a centrifugal clutch positionable to engage a trunnion of the ball valve to move the ball valve between the open position and the closed position when the electric motor reaches an activation rotational speed of the centrifugal clutch.

Example 4 is the system of examples 1-3, wherein the drive system comprises a planetary gear system.

Example 5 is the system of examples 1-4, wherein the drive system comprises a dual planetary gear system comprising a 25:1 gear ratio.

Example 6 is the system of examples 1-5, further comprising a telemetry system for providing wireless control signals to control operation of the electric motor.

Example 7 is the system of examples 1-6, wherein the ball valve is rotatable 360 degrees.

Example 8 is the system of examples 1-7, wherein the electric motor is coupleable to the drive system within the trunnion of the ball valve with a pin that is rotatable by the electric motor within a slot, and wherein the electric motor is operable to rotate the pin within the slot prior to the pin engaging the drive system.

Example 9 is the system of examples 1-8, further comprising an auxiliary battery operable to auto-close the ball valve in response to the power source dissipating below an operational power threshold.

Example 10 is an electric ball valve assembly comprising: a ball valve coupleable to a wellbore comprising a through-bore, the ball valve being rotatable between (i) an open position where a fluid is able to flow through the through-bore and (ii) a closed position where the fluid is prevented from flowing through the through-bore; an electric motor positionable adjacent to a first trunnion of the ball valve to rotate the ball valve between the open position and the closed position; and a power source positionable proximate to the electric motor to provide power to the electric motor.

Example 11 is the assembly of example 10, wherein the electric motor is coupleable to a drive system of the ball valve with a pin that is rotatable by the electric motor within a slot, and wherein the electric motor is operable to rotate the pin within the slot prior to the pin engaging the drive system.

Example 12 is the assembly of examples 10-11, wherein the power source comprises a primary cell, a rechargeable battery pack, or a capacitor bank.

Example 13 is the assembly of examples 10-12, wherein the electric motor comprises a brushless motor comprising a stator assembly and a rotor, and wherein the rotor is positionable to drive a planetary gear system within the first trunnion of the ball valve to rotate the ball valve.

Example 14 is the assembly of examples 10-13, wherein the electric motor comprises a cycloid drive or a harmonic drive comprising a set of coaxial magnetic gears.

Example 15 is a method comprising: receiving a valve control signal from a wireless telemetry system; receiving electric power from a primary cell or a rechargeable battery pack; providing an actuation force to a ball valve coupleable to a wellbore using an electric motor powered by the electric power; and moving the ball valve between an open position and a closed position using the actuation force, wherein in the open position, a fluid is able to flow through a through-bore of the ball valve, and in the closed position, the fluid is prevented from flowing through the through-bore.

Example 16 is the method of example 15, wherein the actuation force is provided to a planetary gear system within a trunnion of the ball valve.

Example 17 is the method of examples 15-16, wherein the electric motor comprises at least one brushless motor, at least one harmonic drive system, or at least one cycloid drive system.

Example 18 is the method of examples 15-17, wherein the ball valve is rotatable 360 degrees.

Example 19 is the method of examples 15-18, further comprising cutting at least one of a slickline, a wireline, or a coil tubing extending through the through-bore of the ball valve as the ball valve moves from the open position to the closed position.

Example 20 is the method of examples 15-19, further comprising: equalizing pressure uphole and downhole of the ball valve prior to moving the ball valve; and locking the ball valve in the open position or the closed position with a solenoid locking mechanism.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a ball valve positionable downhole within a fluid flow path of a wellbore, the ball valve being movable between an open position, where fluid is able to flow through the fluid flow path, and a closed position, where the fluid is prevented from flowing through the fluid flow path;

an electric motor coupleable to a drive system, wherein the electric motor is coupleable to the drive system within a trunnion of the ball valve with a pin that is rotatable by the electric motor within a slot and positionable to drive rotation of the ball valve to move the ball valve between the open position and the closed position, and wherein the electric motor is operable to rotate the pin within the slot prior to the pin engaging the drive system; and a power source electrically coupleable to the electric motor to provide power to the electric motor.

2. The system of claim 1, further comprising:

an additional electric motor coupleable to an additional drive system within an additional trunnion of the ball valve and positionable to drive rotation of the ball valve, wherein the electric motor and the additional electric motor are each positionable to drive rotation of the ball valve in a same rotational direction.

3. The system of claim 1, wherein the electric motor comprises a centrifugal clutch positionable to engage the trunnion of the ball valve to move the ball valve between the open position and the closed position when the electric motor reaches an activation rotational speed of the centrifugal clutch.

4. The system of claim 1, wherein the drive system comprises a planetary gear system.

5. The system of claim 1, wherein the drive system comprises a dual planetary gear system comprising a 25:1 gear ratio.

6. The system of claim 1, further comprising a telemetry system for providing wireless control signals to control operation of the electric motor.

7. The system of claim 1, wherein the ball valve is rotatable 360 degrees.

8. The system of claim 1, further comprising an auxiliary battery operable to auto-close the ball valve in response to the power source dissipating below an operational power threshold.

9. An electric ball valve assembly comprising:

a ball valve coupleable to a wellbore comprising a through-bore, the ball valve being rotatable between (i) an open position where a fluid is able to flow through the through-bore and (ii) a closed position where the fluid is prevented from flowing through the through-bore;

an electric motor positionable adjacent to a first trunnion of the ball valve to rotate the ball valve between the open position and the closed position, wherein the electric motor is coupleable to a drive system of the ball valve with a pin that is rotatable by the electric motor within a slot, and wherein the electric motor is operable to rotate the pin within the slot prior to the pin engaging the drive system; and a power source positionable proximate to the electric motor to provide power to the electric motor.

10. The assembly of claim 9, wherein the power source comprises a primary cell, a rechargeable battery pack, or a capacitor bank.

11. The assembly of claim 9, wherein the electric motor comprises a brushless motor comprising a stator assembly and a rotor, and wherein the rotor is positionable to drive a planetary gear system within the first trunnion of the ball valve to rotate the ball valve.

12. The assembly of claim 9, wherein the electric motor comprises a cycloid drive or a harmonic drive comprising a set of coaxial magnetic gears.

13. The electric ball valve assembly of claim 9, wherein the electric ball valve assembly is positionable downhole within the fluid flow path of the wellbore.

14. A method comprising:

receiving a valve control signal from a wireless telemetry system;

receiving electric power from a primary cell or a rechargeable battery pack;

providing an actuation force to a ball valve positionable downhole within a fluid flow path of a wellbore using an electric motor, wherein the electric motor is coupleable to a drive system of the ball valve within a trunnion of the ball valve with a pin that is rotatable by the electric motor within a slot, the electric motor being powered by the electric power, wherein the electric motor is operable to rotate the pin within the slot prior to the pin engaging the drive system; and moving the ball valve between an open position and a closed position using the actuation force, wherein in the open position, a fluid is able to flow through a through-bore of the ball valve, and in the closed position, the fluid is prevented from flowing through the through-bore.

15. The method of claim 14, wherein the actuation force is provided to a planetary gear system within the trunnion of the ball valve.

16. The method of claim 14, wherein the electric motor comprises at least one brushless motor, at least one harmonic drive system, or at least one cycloid drive system.

17. The method of claim 14, wherein the ball valve is rotatable 360 degrees.

18. The method of claim 14, further comprising cutting at least one of a slickline, a wireline, or a coil tubing extending through the through-bore of the ball valve as the ball valve moves from the open position to the closed position.

19. The method of claim 14, further comprising:

equalizing pressure uphole and downhole of the ball valve prior to moving the ball valve; and locking the ball valve in the open position or the closed position with a solenoid locking mechanism.

20. The method of claim 14, further comprising:

engaging, by the trunnion of the ball valve, a centrifugal clutch of the electric motor to move the ball valve between the open position and the closed position in response to the electric motor reaching an activation rotational speed of the centrifugal clutch.

* * * * *